US006543915B1

(12) United States Patent
Chen

(10) Patent No.: US 6,543,915 B1
(45) Date of Patent: Apr. 8, 2003

(54) RECESSED DOWN LIGHT

(75) Inventor: Shih-Huei Chen, Taipei Hsien (TW)

(73) Assignee: Tai-Jan Luminaire Ltd., Taipei Hsien (TW)

( * ) Notice: Subject to any disclaimer, the term of this patent is extended or adjusted under 35 U.S.C. 154(b) by 27 days.

(21) Appl. No.: 09/955,050

(22) Filed: Sep. 19, 2001

(51) Int. Cl.[7] ..... F21S 8/00; F21V 17/00

(52) U.S. Cl. ..... 362/427; 362/365; 362/366; 362/418

(58) Field of Search ..... 362/427, 388, 362/418, 433, 449, 147, 285, 314, 364, 365, 366, 287, 269, 419

(56) References Cited

U.S. PATENT DOCUMENTS 5,564,815 A * 10/1996 Littman et al. ..... 362/147

5,630,663 A * 5/1997 Ling et al. ..... 362/365

* cited by examiner

*Primary Examiner*—Stephen Husar
*Assistant Examiner*—Bao Truong
(74) *Attorney, Agent, or Firm*—Troxell Law Office PLLC

(57) ABSTRACT

A recessed down light includes a mounting base frame, a rotary carrier revolvably supported in the mounting base frame, two friction members fastened to the mounting base frame and pressed on the rotary carrier and adapted hold the rotary carrier in position when external force disappeared, a lamp holder holding a halogen lamp and pivoted to the rotary carrier for turning in and out of the rotary carrier by hand, and a track frame fastened to the rotary carrier and adapted to guide circular motion of the lamp holder relative to the rotary carrier within 90°.

3 Claims, 6 Drawing Sheets

RECESSED DOWN LIGHT

BACKGROUND OF THE INVENTION

The present invention relates down lights and, more particularly, to a recessed down light, does not damage the surface coating of the parts thereof when adjusting the lighting angle of the lamp.

FIG. 1 shows a recessed down light according to the prior art. This structure of recessed down light 1' comprises a mounting base frame 11', a lamp holder 13' pivoted to the mounting base frame 11', the lamp holder 13' having friction ribs 14' at the back side thereof, and a metal friction plate 12' fixedly fastened to the mounting base frame 11' and pressed on the friction ribs 14'. The friction resistance between the friction ribs 14' and the metal friction plate 12' holds the lamp holder 13' in one of a series of positions. This design enables the lamp holder 13' to be adjusted vertically within 90°. The user cannot adjust the angular position of the lamp holder 13' horizontally. Further, when adjusting the position of the lamp holder 13', the surface coating of the lamp holder 13' may be damaged because it is moved over the metal friction plate 12'.

SUMMARY OF THE INVENTION

The present invention has been accomplished to provide a recessed down light, which eliminates the aforesaid drawbacks. It is one object of the present invention to provide a recessed down light, which enables the user to adjust the angular position of the lamp horizontally within 355° and vertically within 87° without tangling the electric wires. It is another object of the present invention to provide a recessed down light, which does not cause damage to the surface coating of the lamp holder when adjusting the angular position of the lamp. To achieve these and other objects of the present invention, the recessed down light comprises a mounting base frame, a rotary carrier revolvably supported in the mounting base frame, two friction members fastened to the mounting base frame and pressed on the rotary carrier and adapted hold the rotary carrier in position when external force disappeared, a lamp holder holding a halogen lamp and pivoted to the rotary carrier for turning in and out of the rotary carrier by hand, and a track frame fastened to the rotary carrier and adapted to guide circular motion of the lamp holder in vertical direction within 87°. Further, the lamp holder has a fixed cushion disposed in contact with the track frame, preventing damage to the surface coating of the lamp holder when adjusting the angular position of the lamp holder vertically.

DETAILED DESCRIPTION OF THE PREFERRED EMBODIMENT

Figure 1:
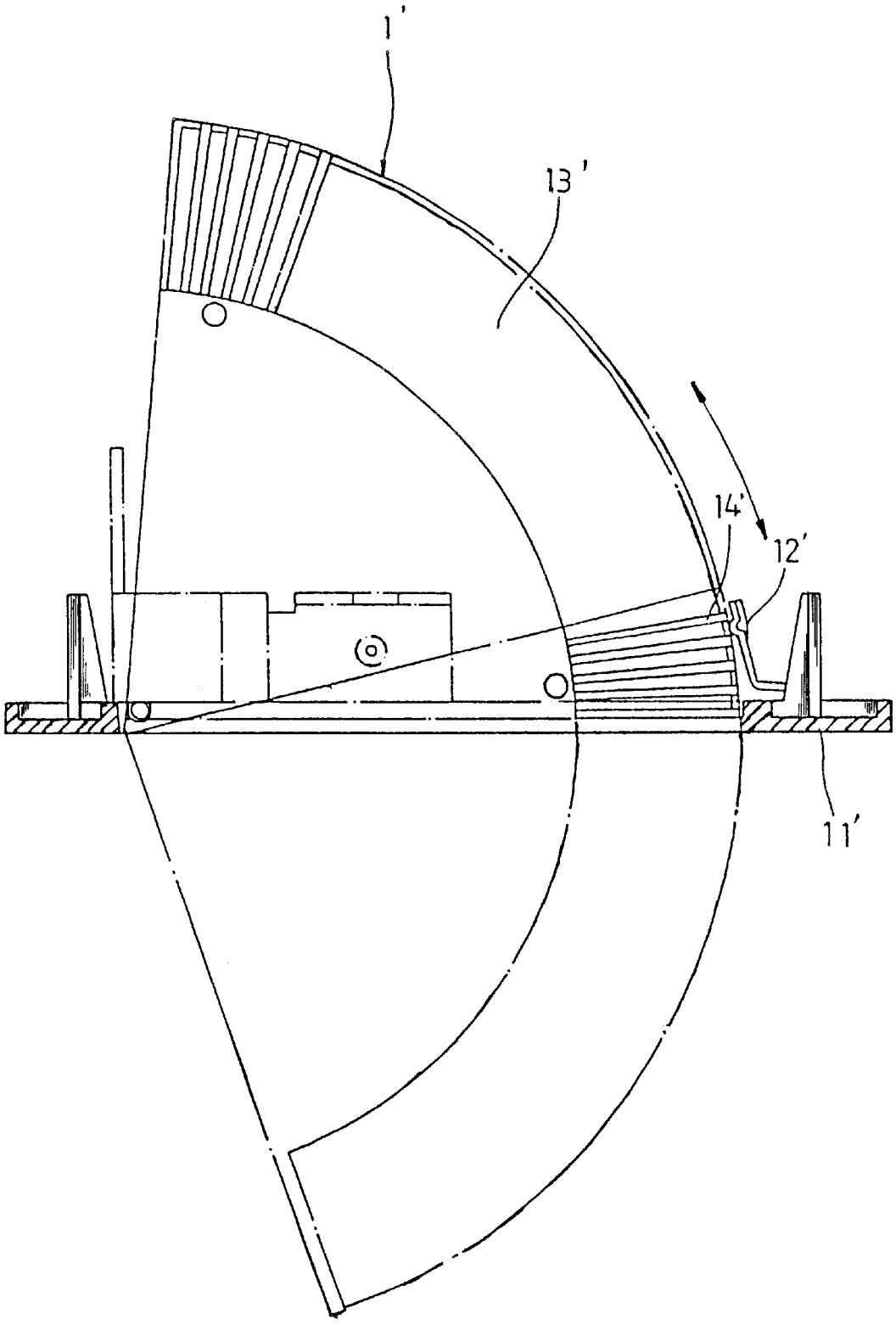
FIG.1 Prior Art
FIG. 1 illustrates the structure and action of a recessed down light according to the prior art.
Figure 2:
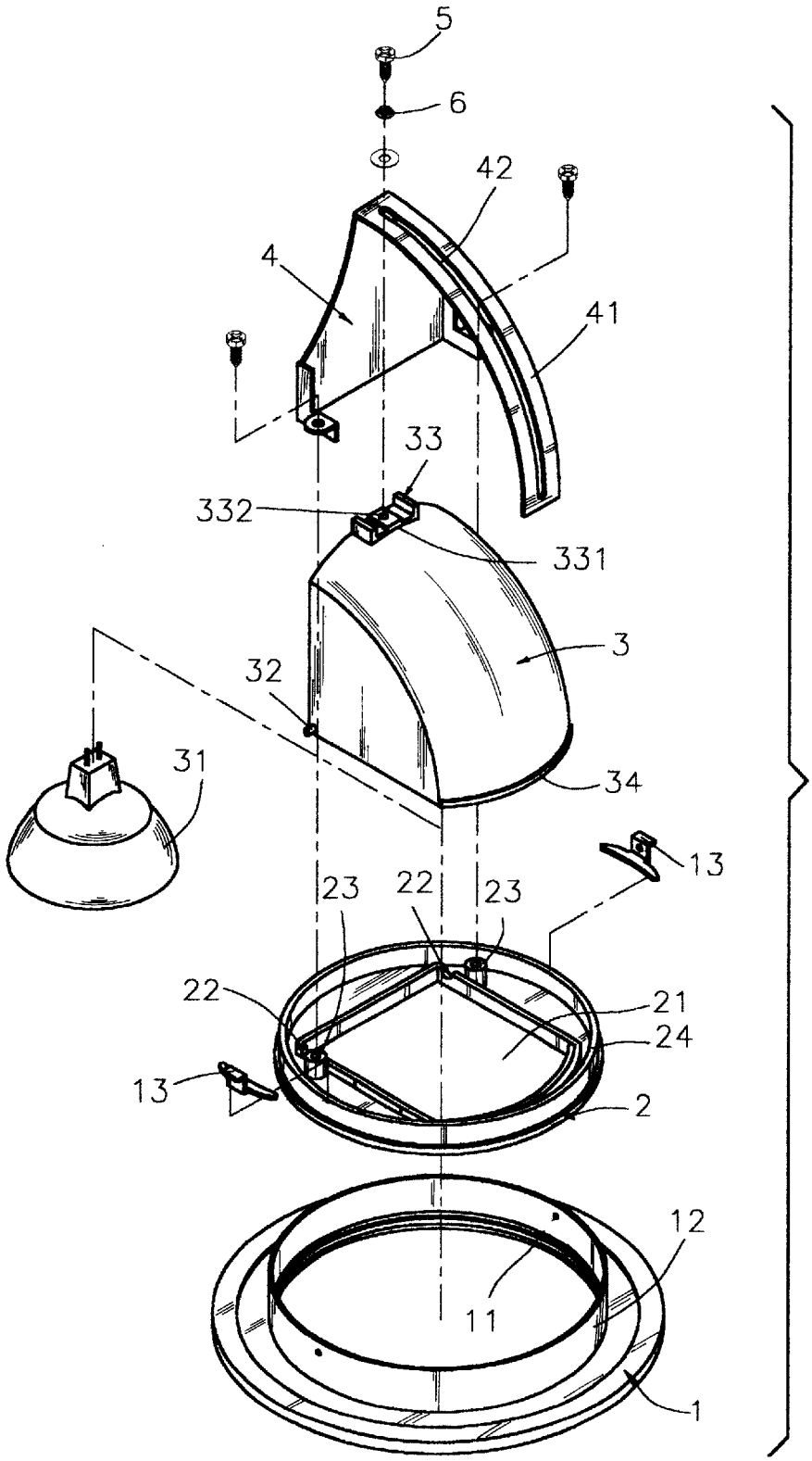
FIG. 2 is an exploded view of a recessed down light according to the present invention.
Figure 3:
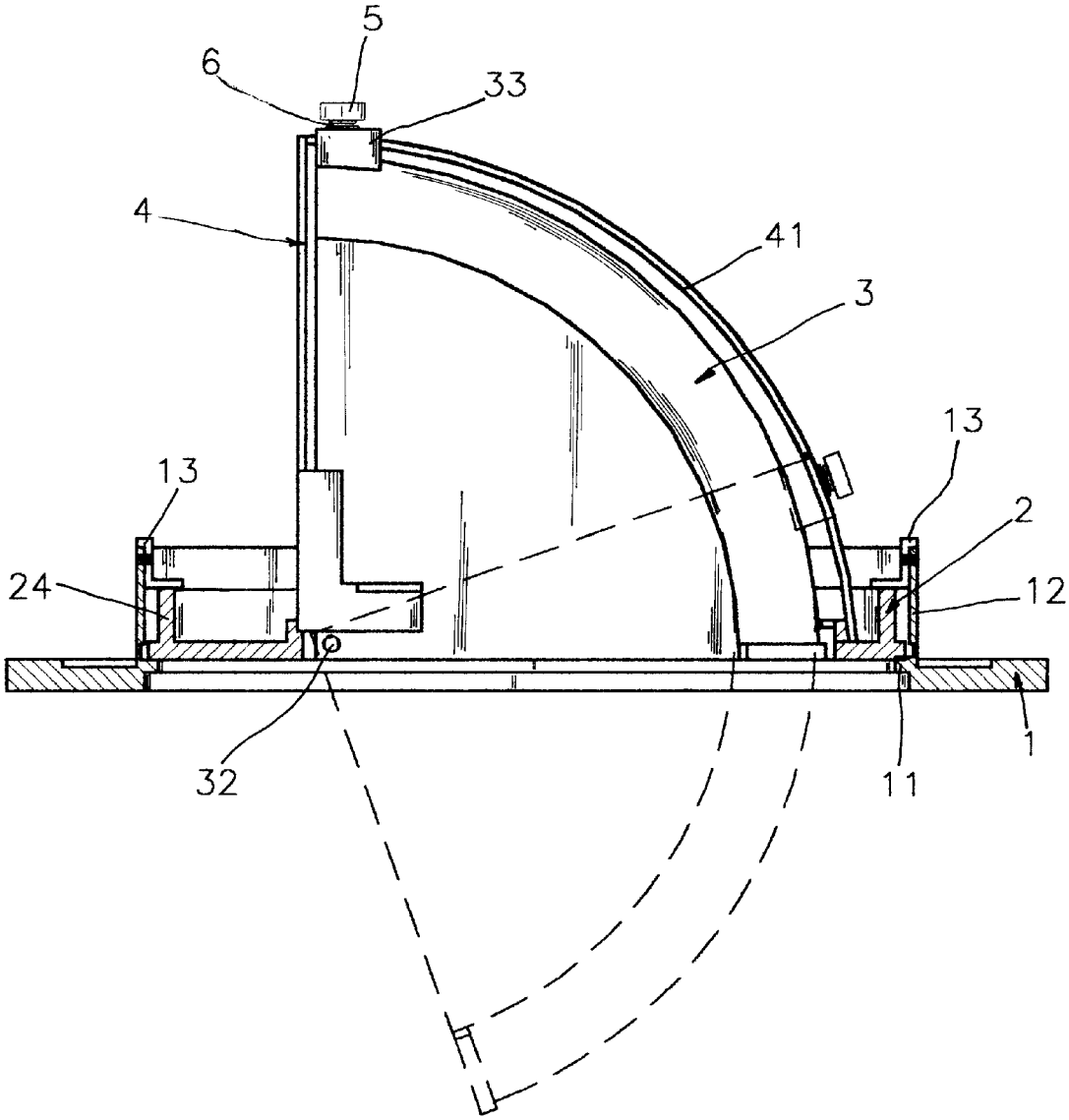
FIG. 3 is a schematic drawing showing the action of the recessed down light according to the present invention.
Figure 4:
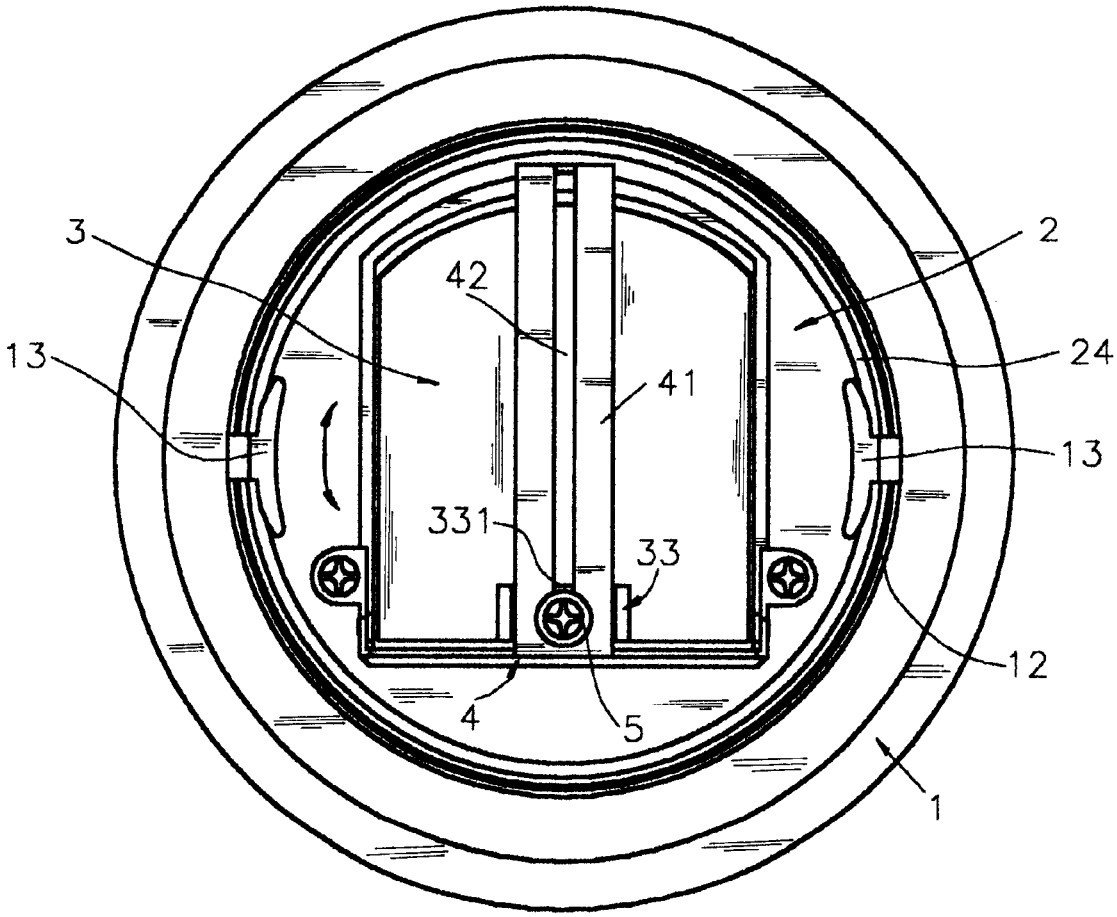
FIG. 4 is a schematic drawing of the present invention showing the rotary motion of the rotary carrier within the mounting base frame.

Referring to FIGS. from 2 through 7, a recessed down light in accordance with the present invention is generally comprised of a mounting base frame 1, a rotary carrier 2, a lamp holder 3, and a track frame 4.

The mounting base frame 1 is a hollow circular member for fastening to a mounting hole in the ceiling (not shown), having an upward insertion flange 12 disposed around the center opening thereof for insertion into the mounting hole of the ceiling, an inside annular flange 11 horizontally extended around the inner surface of the upward flange 12 at a bottom side, and two friction members 13 bilaterally fastened to the upward insertion flange 12.

The rotary carrier 2 is revolvably supported on the inside annular flange 11 of the mounting base frame 1 within the upward flange 12, comprising a center open frame 21, two notches 22 bilaterally disposed near one end of the center open frame 21, two upright rods 23 respectively disposed adjacent to the notches 22, and an endless upright peripheral wall 24. The friction members 13 of the mounting base frame 1 are respectively disposed in contact with the inner surface of the endless upright peripheral wall 24 of the rotary carrier 2, imparting a friction resistance to the rotary carrier 2 to hold it in place. In order to prevent tangling of electric wires, the rotary carrier 2 is set to be rotated horizontally on the mounting base frame 1 within 355°.

The lamp holder 3 is a ¼ sector-like casing holding a halogen lamp 31, having two pivot rods 32 bilaterally disposed at the bottom of the front side thereof and respectively pivoted to the notches 22, and a U-shaped locating member 33 fixedly fastened to the topmost edge of the front side. The locating member 33 has a rectangular cushion 331 fixedly provided at the center. The rectangular cushion 331 has a center mounting hole 332.

The track frame 4 is fastened to the upright rods 23 over the lamp holder 3 to limit the turning angle of the lamp holder 3, comprising a smoothly arched track 41. The track 41 has a longitudinal sliding slot 42. A screw 5 is inserted through a washer 6 and the longitudinal sliding slot 42 of the track 41 and threaded into the mounting hole 332 of the cushion 331 of the U-shaped locating member 33. The rear end of the track 41 is stopped against a part of the rotary carrier 2 between the center open frame 21 and the endless upright peripheral wall 24. Therefore, the lamp holder 3 can be turned about the axis passing through the notches 22 along the track 41 upwards/downwards within 87°. The cushion 331 keeps the track 41 from contacting the surface coating of the lamp holder 3.

The lamp holder 3 further comprises a stop flange 34 horizontally extended along the smoothly arched bottom of the rear side thereof. When set back to the inside of the mounting base frame 1 and the rotary carrier 2, the stop flange 34 is stopped at the bottom side of the peripheral wall of the center open frame 21 to limit the upward turning angle of the lamp holder 3.

Figure 5:
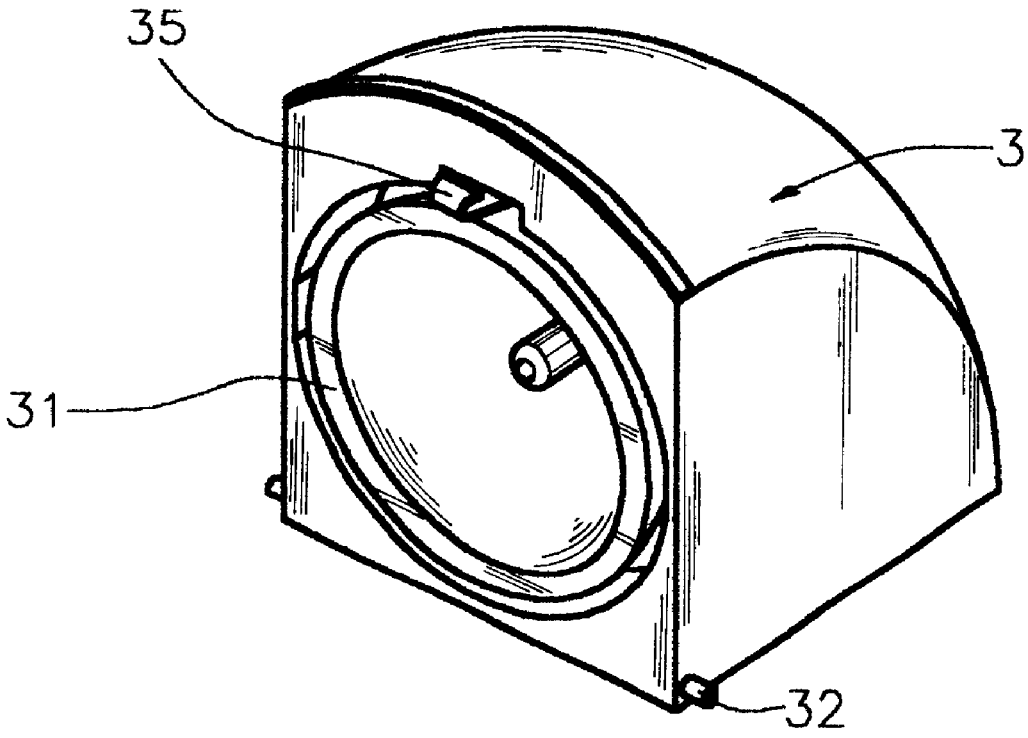
FIG. 5 is an elevational view of the lamp holder for the recessed down light according to the present invention.
Figure 6:
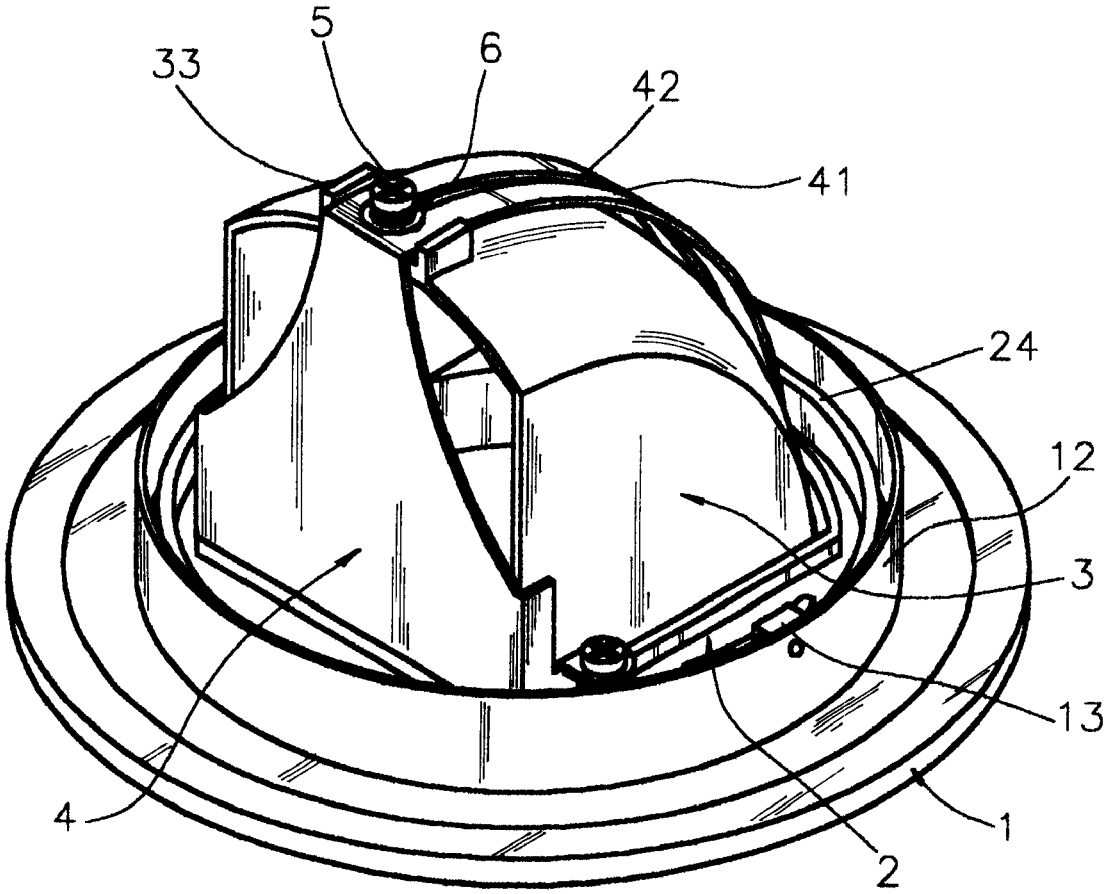
FIG. 6 is an elevational view of the recessed down light according to the present invention.

Referring to FIG. 5 again, the lamp holder 3 further comprises a protruding finger strip 35 through which the lamp holder 3 can be conveniently turned in and out of the rotary carrier 2 with the hand.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A recessed down light comprising:

a mounting base frame fastened to a mounting hole in a ceiling, said mounting base frame having an upward insertion flange disposed around the center opening thereof and inserted into the mounting hole of the ceiling, and an inside annular flange within said upward flange at a bottom side;

a rotary carrier revolvably supported on the inside annular flange of said mounting base frame within said upward flange, said rotary carrier comprising a center open frame, two notches bilaterally disposed near one end of said center open frame, two upright rods respectively disposed adjacent to said notches, and an endless upright peripheral wall;

two friction members bilaterally fastened to the upward insertion flange of said mounting base frame and respectively disposed in contact with an inner surface of said endless upright peripheral wall of said rotary carrier to impart a friction resistance to said rotary carrier;

a track frame fixedly fastened to the upright rods of said rotary carrier, said track frame, said track frame comprising a smoothly arched track; and a lamp holder pivoted to the notches of said rotary carrier and coupled to said track frame for moving in and out of said center open frame of said rotary carrier by hand along said smoothly arched track of said track frame.

2. The recessed down light as claimed in claim 1 wherein said smoothly arched track of said track frame has a longitudinal sliding slot adapted to guide movement of said lamp holder within 90°, and said lamp holder comprises a U-shaped guide member fixedly disposed at a top side thereof and a screw fastened to said U-shaped guide member to guide movement of said lamp holder along said longitudinal sliding slot of said track and for enabling said U-shaped guide member to be fixedly secured to said smoothly arched track at a selected position.

3. The recessed down light as claimed in claim 1 wherein said U-shaped guide member has a fixed cushion disposed in contact with said smoothly arched track of said track frame.

* * * * *